United States Patent [19]

Jardinier et al.

[11] 4,074,862

[45] Feb. 21, 1978

[54] ADJUSTABLE FLOW AIR INSUFFLATION NOZZLE

[75] Inventors: Pierre Jardinier, Gournay sur Marne; Jack Simonnot, Ozoire la Ferriere; Robert Lecerf, Neuilly sur Marne, all of France

[73] Assignee: Societe d'Etudes et de Recherches de Ventilation et d'Aeraulique, Gournay sur Marne, France

[21] Appl. No.: 705,941

[22] Filed: July 16, 1976

[30] Foreign Application Priority Data

July 23, 1975 France ..... 75 23022

[51] Int. Cl.[2] ..... F24F 13/06

[52] U.S. Cl. ..... 239/515; 239/524

[58] Field of Search ..... 239/505, 507, 509, 510, 239/512–515, 518, 521, 522–524

[56] References Cited

U.S. PATENT DOCUMENTS

| | | | |
|---|---|---|---|
| 1,287,272 | 12/1918 | Fisher | 239/515 X |
| 2,187,324 | 1/1940 | Many | 239/518 X |
| 2,338,273 | 1/1944 | Wilkins | 239/522 |
| 3,018,823 | 1/1962 | Alger | 239/524 X |

FOREIGN PATENT DOCUMENTS

| | | | |
|---|---|---|---|
| 557,686 | 8/1923 | France | 239/515 |

*Primary Examiner*—Evon C. Blunk
*Assistant Examiner*—Andres Kashnikow
*Attorney, Agent, or Firm*—Browdy and Neimark

[57] ABSTRACT

An insufflation nozzle, which has a plane of symmetry, includes a sleeve having an inlet which is symmetrical about an axis and an outlet orifice. A deflector is disposed to face the outlet orifice and extends transversely with respect to the axis. A link is provided between the deflector and the sleeve to permit movement of these components relative to one another. The link includes a screen disposed symmetrically with respect to the plane of symmetry. A surface of the deflector which is directed toward the sleeve has planar portions which are inclined relative to the axis and have a spacing, relative to the outlet orifice of the sleeve, which increases along a direction extending away from the screen.

10 Claims, 3 Drawing Figures

ADJUSTABLE FLOW AIR INSUFFLATION NOZZLE

BACKGROUND OF THE INVENTION

The present invention relates to an air insufflation nozzle intended to be connected to a ventilation or air conditioning conduit.

It is known that many buildings include on every floor a series of contiguous rooms of identical height but of different widths, the rooms being serviced by a common corridor. The ventilation of such premises is frequently ensured from a common air supply conduit which is, for example, disposed in a caisson formed in the angle formed by the ceiling and the partitions which separate the rooms along the corridor. The air requirements of these different rooms are generally proportional to their respective volumes and thus their widths. In order to obtain pleasant and efficient ventilation, air has to be blown into each room along directions which are parallel to the ceiling and it is necessary to prevent this air from sinking in the immediate vicinity of the insufflation nozzle. Moreover, in order that the ventilation should be homogeneous it should be possible to diffuse the air into each room within a sector the angular width, i.e., horizontal included angle, of which is proportional to the width of the room and consequently to the air volume flow rate corresponding to that room.

SUMMARY OF THE INVENTION

It is the principal object of the present invention to provide an insufflation nozzle which provides a solution for the above-mentioned problems.

According to the present invention an insufflation nozzle having a plane of symmetry is provided. The nozzle includes a sleeve having an inlet which is symmetrical about an axis; a deflector disposed to face the outlet orifice of the sleeve and extending transversely with respect to the axis. Linking means are provided for linking the deflector and the sleeve so as to permit a translational movement of these two components relative to one another in a direction parallel to the axis. The linking means includes a screen which is symmetrically disposed with respect to the plane of symmetry for the purpose of shutting off passage of air between the sleeve and the deflector in a specific angular sector. That surface of the deflector which is directed toward the sleeve has, at least in the vicinity of its edges adjacent the screen, planar portions which are inclined relative to the axis, and have a spacing relative to the outlet orifice of the sleeve which increases along a direction extending away from the screen.

Preferably the surface of the deflector further includes, in the vicinity of its edge remote from the screen, a substantially planar portion which is perpendicular to the axis of the sleeve inlet.

It has, in fact, been found that when the deflector is shifted axially with respect to the sleeve, so as to cause the volume flow rate of air to vary, provided the pressure upstream of the sleeve remains substantially constant, the air flow spreads out in an angular sector the horizontal included angle of which becomes larger when the flow rate increases, while in the absence of the above mentioned inclined planes the air tends to escape in the neighborhood of the screen, the flow in the direction away from the screen being very weak. Furthermore, the air escapes from the nozzle along an initial path substantially normal to the axis of the sleeve.

According to an advantageous embodiment of the invention the surface of the deflector includes a curved portion bounded by the screen and the aforesaid planar portions, this curved portion being symmetrical with respect to the plane of symmetry and the spacing, measured in a direction parallel to the axis of the sleeve inlet, between this curved surface and the outlet orifice of the sleeve is smallest at the point of intersection of the plane of symmetry with the screen and with this surface portion. Preferably at each point adjacent the plane of symmetry of at least part of the curved surface portion of the cross-sections of this curved surface through planes parallel to the plane of symmetry slope more steeply relative to a direction parallel to the axis of the sleeve than do the cross sections of this surface through planes parallel to the axis of the sleeve and perpendicular to the plane of symmetry.

It has been found that such a curved surface portion on the deflector ensures homogeneous distribution of the air blown into the above-mentioned angular sector, and that the horizontal included angle of this sector widens with increasing air volume flow rate.

BRIEF DESCRIPTION OF THE DRAWINGS

In order that the present invention may more readily be understood the following detailed description is given, merely by way of example with reference to a preferred embodiment of the invention illustrated in the accompanying drawings, wherein.

DETAILED DESCRIPTION OF THE PREFERRED EMBODIMENT

Figure 1:
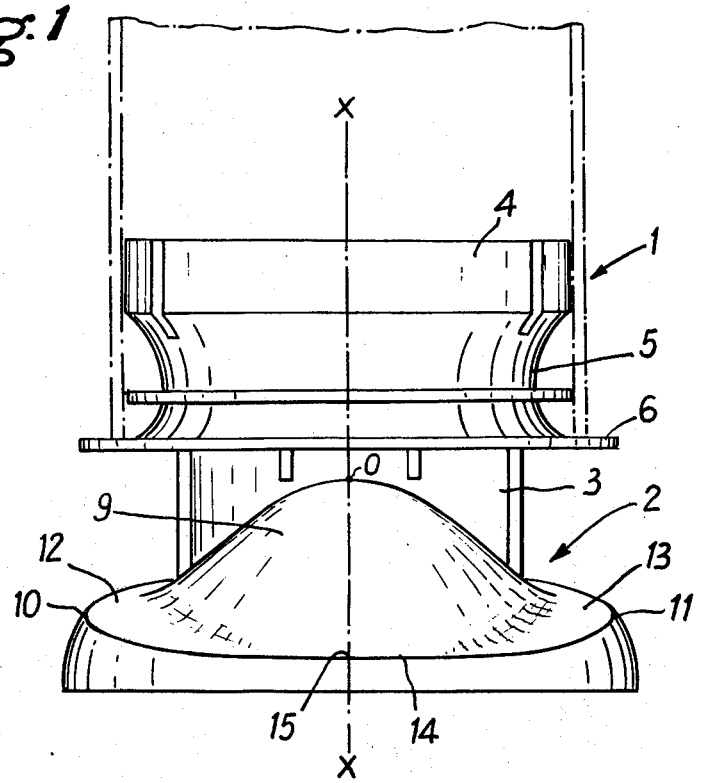
FIG. 1 is a view in frontal elevation of an insufflation nozzle according to the invention.
Figure 2:
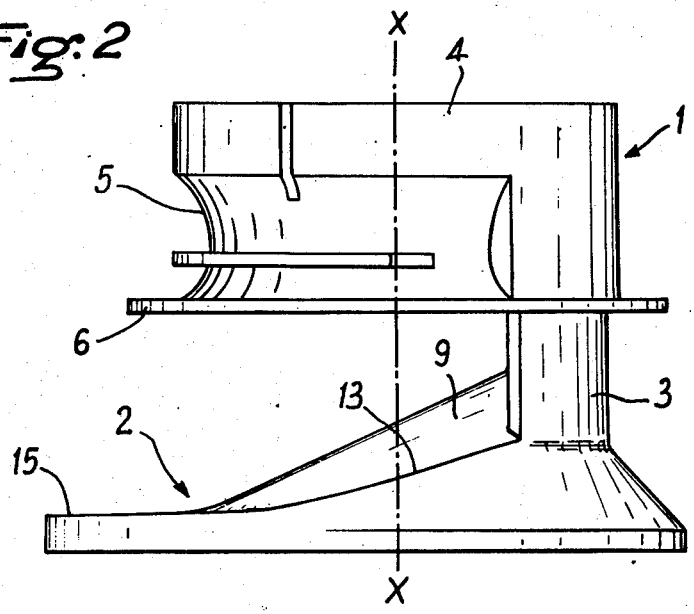
FIG. 2 is an elevational view in a direction perpendicular to the view of FIG. 1.
Figure 3:
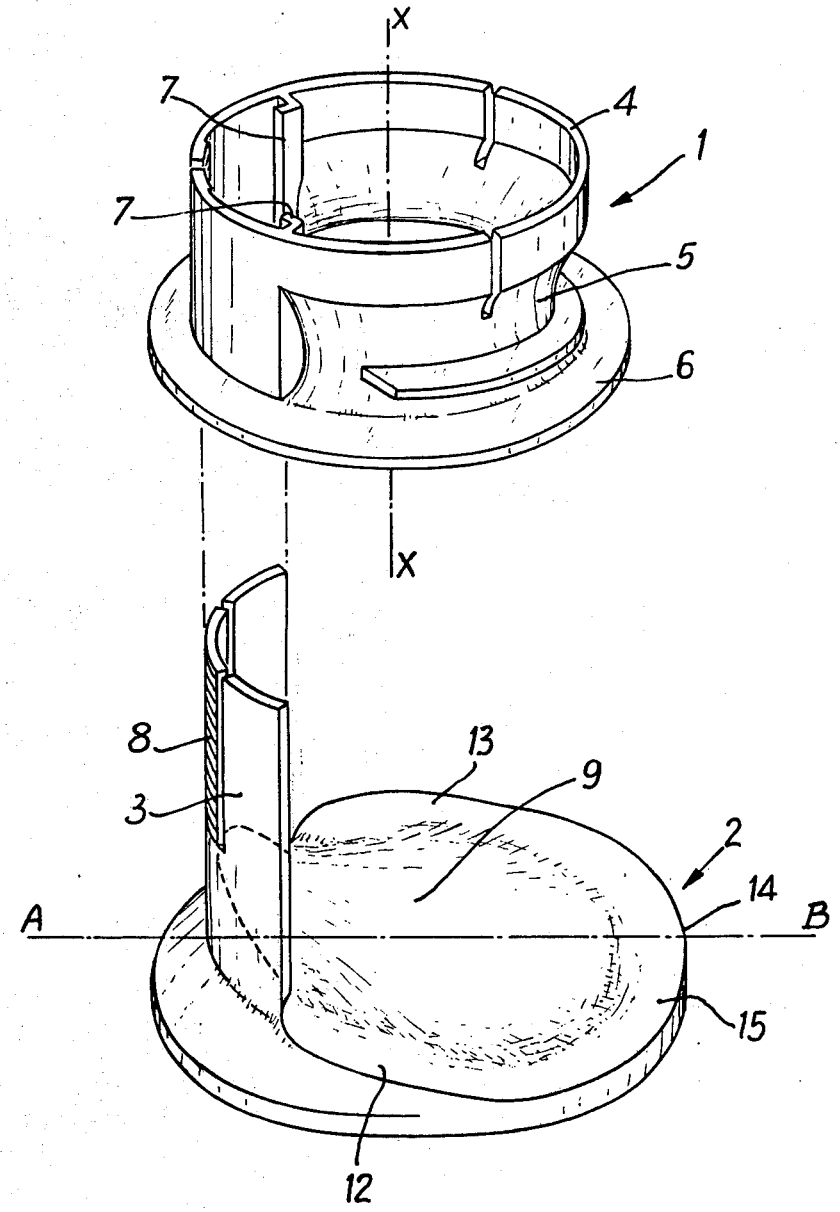
FIG. 3 is an exploded view in perspective view showing the two constituents of the insufflation nozzle illustrated in FIGS. 1 and 2.

The illustrated insufflation nozzle shown in FIGS. 1–3, includes a connection sleeve 1, and a deflector 2 provided with a linking tongue 3, the whole assembly being symmetrical with respect to a plane containing an axis X—X and orthogonal to the plane of the paper on which FIG. 1 is drawn.

The sleeve 1 is intended to be connected to a ventilation or air conditioning conduit the walls of which are shown in dot-dash lines in FIG. 1. This sleeve 1 has a cylindrical inlet 4 which is symmetrical with respect to the axis X—X and which is followed, in the direction of air flowing, by a convergent-divergent throat section 5. The sleeve 1 ends in a flange 6 which is perpendicular to the axis of symmetry X—X and defines the sleeve outlet orifice.

The connection tongue 3, fastened to the deflector 2, is formed of part of a cylinder which is coaxial with the cylindrical inlet 4 of the sleeve 1 and has its outer surface adapted to conform to the inner wall of the sleeve 1 in contact therewith.

This tongue 3 forms a screen which is cylindrical in part and cuts off air flow over the corresponding sector around the nozzle axis X—X.

The sleeve 1 has internally positioned slides 7 (FIG. 3) for the purpose of guiding the flow-screening connection tongue 3 for translational sliding along a direction parallel to the axis X—X.

The outer surface of the flow-screening connecting tongue 3 has a set of serrations or ribs 8 in a rack-like array to cooperate with a similar rack-like array of serrations or ribs of the inner wall of the sleeve 1 so as to ensure high friction between these two components and to mutually immobilize them in a selected position of adjustment.

That face of the deflector 2 which is directed towards the sleeve 1 is symmetrical relative to the median plane of the flow-screening connection tongue 3, which median plane passes through the axis X—X and forms the above-mentioned plane of symmetry. In FIG. 3 the line A-B is an example of a line which lies in the aforementioned plane of symmetry and is perpendicular to axis X—X.

The aforementioned face of the deflector 2 has a curved central portion 9 which is symmetrical with respect to the aforementioned plane of symmetry and forms a protuberance relative to the remainder of this face of the deflector 2. A peak 0 (FIG. 1) of this protuberance, which corresponds to the minimum spacing between the face of the deflector 2 and the plane of the outlet orifice defined by the flange 6 of the sleeve 1, is situated in the plane of symmetry where the curved central portion 9 of the surface and the inner wall of the flow-screening connection tongue 3 intersect.

It is furthermore envisaged that at each point in the central surface portion 9, at least throughout the parts to either side of the plane of symmetry, the cross section of this surface portion 9 in a plane parallel to the plane of symmetry should slope, relative to a line which is parallel to the axis X—X but through the point in question, more steeply than does the cross section at the same point in a plane which is parallel to the axis X—X and perpendicular to the plane of symmetry. This means that the spacing between the surface 9 and the plane of the outlet orifice of the sleeve 1 increases more rapidly as one moves away from the tongue 3 along a direction parallel to the plane of symmetry than when one moves away from this plane of symmetry along a direction perpendicular thereto.

The surface 9 may, in particular, be a part-cylindrical surface. In the vicinity of edges 10 and 11 of the deflector surface adjacent the flow-screening connection tongue 3, this part-cylindrical surface joins planar portions 12, 13 which are inclined relative to the axis X—X in such as sense that, measured parallel to this axis, the spacing between these planar portions 12, 13 and the plane of the outlet orifice of the sleeve 1 increases as one moves away from the flow-screening connection tongue 3.

In the vicinity of an edge portion 14 remote from the tongue 3, the surface of the deflector 2 has a planar portion 15 which is substantially perpendicular to the axis X—X.

In the illustrated embodiment the planar portions 12,13 and 15 are situated substantially opposite the outlet orifice defined by the flange 6 of the sleeve 1.

The sleeve 1, the deflector 2 and the flow-screening connection tongue 3 may, for example, be made of molded plastics material.

In operation, the tongue 3 is thrust into the interior of the sleeve 1 by a specific distance so as to define the flow of air desired for the volume or room to be ventilated or air conditioned, for example to the position shown in FIGS. 1 and 2. Under these circumstances the flow-screening connection tongue 3 forms a screen which prevents any flow radially outwardly of the nozzle in the angular sector corresponding to the tongue 3.

Experience has shown that the air insufflated through such a nozzle leaves the latter along an initial path substantially perpendicular to the axis X—X. Thus, when the nozzle is mounted to the ceiling of a room to be ventilated, with the axis X—X substantially vertical, the insufflated air begins to sink in this room only when it has travelled horizontally to some distance from the nozzle.

Experience has also shown that, the pressure in the supply conduit remaining constant upstream of the nozzle, the air blown in spreads in homogeneous manner in an angular sector having its apex at the intersection of the plane of symmetry with the flow-screening connection tongue 3, and the width of which sector increases when the flow rate is caused to increase by movement of the deflector 2 away from the sleeve 1. Thus in the application mentioned in the introduction, the opening of this sector is substantially proportional to the width of the premises to be ventilated.

The invention is, of course, not limited to the described embodiment but covers any variants of design falling within the scope of the appended claims.

What is claimed is:

1. An insufflation nozzle for air to be used in room ventilation, air conditioning and like systems, the nozzle having a plane of symmetry and comprising in combination:

a sleeve having an outlet orifice and an inlet which is symmetrical about an axis of the nozzle;

a deflector disposed to face said outlet orifice of said sleeve and extending transversely with respect to said axis; and linking means between said deflector and said sleeve so as to permit a translational movement of these two components relative to one another in a direction parallel to said axis for allowing volume flow rate of air to be varied including a screen which is symmetrically disposed with respect to said plane of symmetry for the purpose of shutting off passage of air between said sleeve and said deflector in a specific, given angular sector, a surface of said deflector being directed toward said sleeve and having, at least in the vicinity of its edges adjacent said screen, planar portions which are inclined relative to said axis, and having a spacing relative to said outlet orifice of said sleeve which increases along a direction extending away from said screen;

whereby air flow spreads out in an angular sector, the horizontal included angle of which becomes larger as the flow rate of air increases for a given pressure upstream from the screen and the air escapes from the nozzle along an initial path substantially normal to the axis of the sleeve.

2. A nozzle according to claim 1, wherein in the vicinity of its edge remote from said screen, said surface of said deflector further includes a substantially planar portion perpendicular to the axis of said sleeve.

3. A nozzle according to claim 1, wherein said surface of the deflector further comprises a curved portion which is bounded by said screen and said planar portions and is symmetrical relative to said plane of symmetry, and wherein the spacing measured parallel to said axis of said inlet of said sleeve, between said curved portion and said outlet orifice of said sleeve is smallest at a point of intersection of said plane of symmetry, said screen, and said surface of said deflector.

4. A nozzle according to claim 3, wherein, at each point of at least part of said curved surface portion adjacent said plane of symmetry, the cross-section of said curved surface in planes parallel to said plane of symmetry slopes more steeply with respect to a direction parallel to the axis of said sleeve than does the cross-section of this surface at the same point through a plane parallel to the axis of said sleeve but perpendicular to said plane of symmetry.

5. A nozzle according to claim 4, wherein the said curved surface portion is cylindrical in part.

6. A nozzle according to claim 5, wherein the said screen is formed by part of a cylinder coaxial with said inlet of said sleeve and secured to said deflector, this part cylinder being adapted to slide in slides disposed on the inner face of said sleeve.

7. A nozzle according to claim 6, wherein said sleeve includes a convergent-divergent section upstream of said outlet orifice which faces said deflector.

8. A nozzle according to claim 1, wherein at least one of said planar portions is situated substantially opposite edges of said outlet orifice of said sleeve.

9. A nozzle according to claim 1, wherein the said screen is formed by part of a cylinder coaxial with said inlet of said sleeve and secured to said deflector, this part cylinder being adapted to slide in slides disposed on the inner face of said sleeve.

10. A nozzle according to claim 1, wherein said sleeve includes a convergent-divergent section upstrwam of said outlet orifice which faces said deflector.

* * * * *